United States Patent [19]

Burtis

[11] 4,232,403

[45] Nov. 11, 1980

[54] TRANSFORMABLE CHRISTENING BONNET AND BRIDE'S HANDKERCHIEF

[76] Inventor: Kathryn S. Burtis, 74116 De Anza Way, Palm Desert, Calif. 92660

[21] Appl. No.: 26,025

[22] Filed: Apr. 2, 1979

[51] Int. Cl.[2] ..... A42B 1/20; A42B 15/04

[52] U.S. Cl. ..... 2/204; 2/209.1

[58] Field of Search ..... 2/204, 209.3, 196, 198, 2/195, 200, 175, 1, 279, 171, 209.1; 229/71; 40/159

[56] References Cited

U.S. PATENT DOCUMENTS

| | | | |
|---|---|---|---|
| 908,197 | 12/1908 | Bernstein | 2/204 |
| 1,299,329 | 4/1919 | Griffith | 2/209.3 |
| 2,112,774 | 3/1938 | Thorman | 2/198 X |
| 2,318,461 | 5/1943 | Bunker | 229/71 |
| 2,673,350 | 3/1954 | Chuck | 2/204 X |
| 2,832,961 | 5/1958 | Weiss | 2/200 X |

FOREIGN PATENT DOCUMENTS

| | | | |
|---|---|---|---|
| 1217901 | 12/1959 | France | 40/159 |

*Primary Examiner*—Peter P. Nerbun

*Attorney, Agent, or Firm*—William C. Babcock

[57] ABSTRACT

In combination with a message containing folder of opaque material that holds a bride's decorative handkerchief that by light stitching has been transformed to a baby's christening bonnet, with the stitching when removed permitting the handkerchief to be used as such by a bride of succeeding generation, and thereafter by light stitching again returned to the configuration of a baby's christening bonnet. The opaque folder not only provides for safekeeping of the decorative handkerchief but also serves as a medium for a message and record of the number of times and date when the handkerchief was used as a christening bonnet, but also protects the handkerchief from deteriorating due to exposure to light.

7 Claims, 6 Drawing Figures

TRANSFORMABLE CHRISTENING BONNET AND BRIDE'S HANDKERCHIEF

BACKGROUND OF THE INVENTION

1. Field of the Invention

Transformable Christening Bonnet and Bride's Handkerchief.

2. Description of the Prior Art

In weddings, the bride receives numerous gifts, but seldom are these gifts of such a nature as to be of lasting value.

The primary purpose of the present invention is to provide an assembly that is admirably suited for a bride's gift, with the assembly including an opaque folder that contains a suitable congratulatory message and record of when the christening bonnet was used, and also a bride's decorative handkerchief that by a simple stitchery operation is transformable into a christening bonnet, and the bonnet after use being returnable to the original handkerchief configuration by removing the stiching and a pair of ribbons therefrom.

A still further object of the invention is to supply a folder in which a permanent record is maintained of the date of weddings of a succession of generations in which the handkerchief was carried by the bride, and pertinent information concerning each wedding.

SUMMARY OF THE INVENTION

A bride's decorative handkerchief in combination with an opaque folder to protect the same from the deteriorating action of light, which folder also may contain a congratulatory message, as well as records of wedding and christening of succeeding generations. By a simple folding and light stitching operation the handkerchief in conjunction with two lengths of ribbon is transformed into a baby's christening bonnet that may be retained as such within the folder. By removing the stitching and ribbons, the christening bonnet may be returned to the initial configuration of a handkerchief. Thus, the handkerchief may be used alternately by succeeding generations by brides and for christening purposes.

DESCRIPTION OF THE PREFERRED EMBODIMENT

Figure 1:
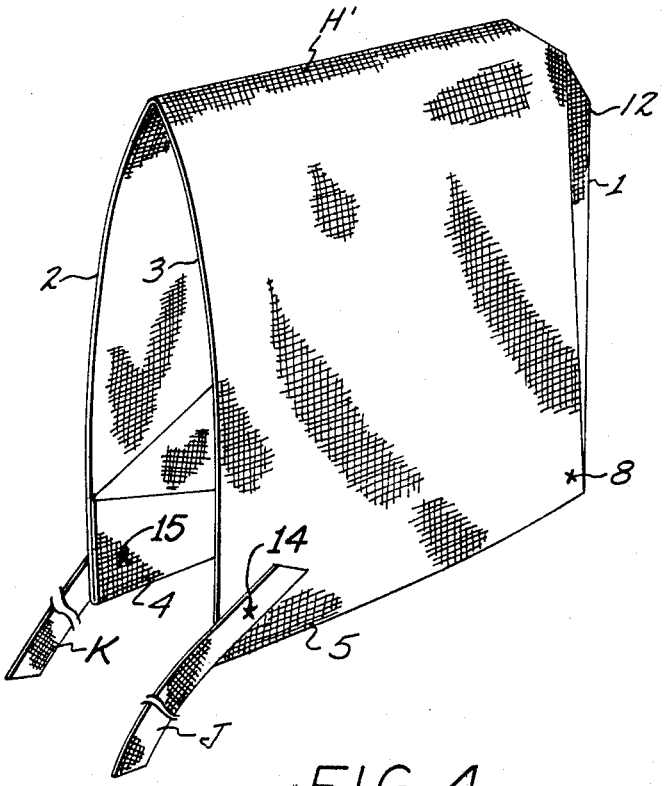
FIG. 1 is a perspective view of the bride's handkerchief, which in combination with two lengths of ribbon is transformed to a baby's christening bonnet.
Figure 2:
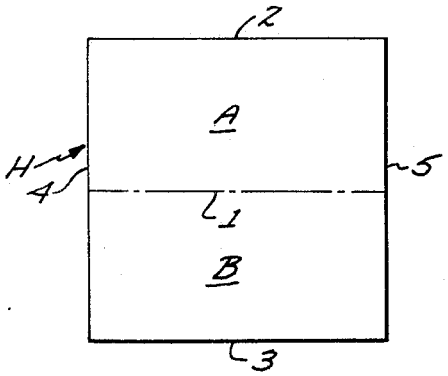
FIG. 2 is a top plan view of the handkerchief illustrating the first fold line that will be formed therein to transform the same to a christening bonnet.

The bride's decorative handkerchief H shown in plan view in FIG. 2 in cooperation with two lengths of ribbon J and K is transformable into the baby's christening bonnet 14' illustrated in FIG. 1.

The handkerchief H as best seen in FIG. 2 has a pair of first and second end edges 2 and 3 and a pair of first and second side edges 4 and 5. By folding the handkerchief H along a folding line 1, the handkerchief is divided into first and second rectangular panels A and B of substantially equal area. The second panel B in this folding is moved upwardly to overlie the first panel as shown in FIG. 2.

Figure 3:
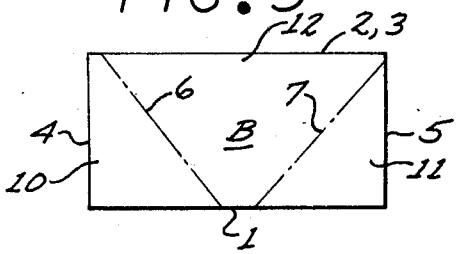
FIG. 3 is a top plan view of the handkerchief with second and third lines defined thereon.
Figure 4:
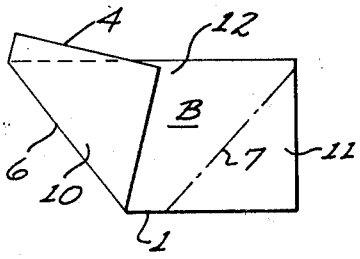
FIG. 4 is a top plan view of the handkerchief in a second stage in the folding thereof.
Figure 5:
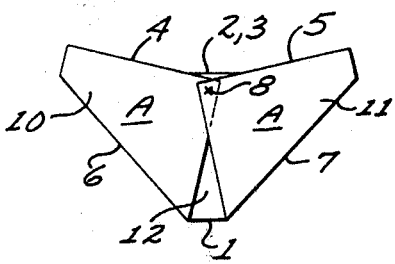
FIG. 5 is a top plan view of the handkerchief in a third stage in the folding thereof.

The doubled over panel A and B when disposed as shown in FIG. 3 may by laterally spaced folding lines 6 and 7 be divided into first and second generally triangular shaped segments 10 and 11 that are separated by a generally trapezoidal shaped intermediate portion 12. In FIG. 5 it will be seen that the second folding line 6 is utilized to dispose the first segment in an overlying position on intermediate portion 12, and the second segment 11 to have a part thereof overlie the first segment. The overlying portions of the first and second segments are removably secured together by light stitching 8.

The christening bonnet H' resulting from the above-described operation is completed by first and second ribbons J and K being secured thereto by light stitching 14 and 15 as shown in FIG. 1 adjacent the lower forward extremities thereof. The first and second ribbons J and K may be tied together to hold the christening bonnet H' on a baby's head (not shown).

Figure 6:
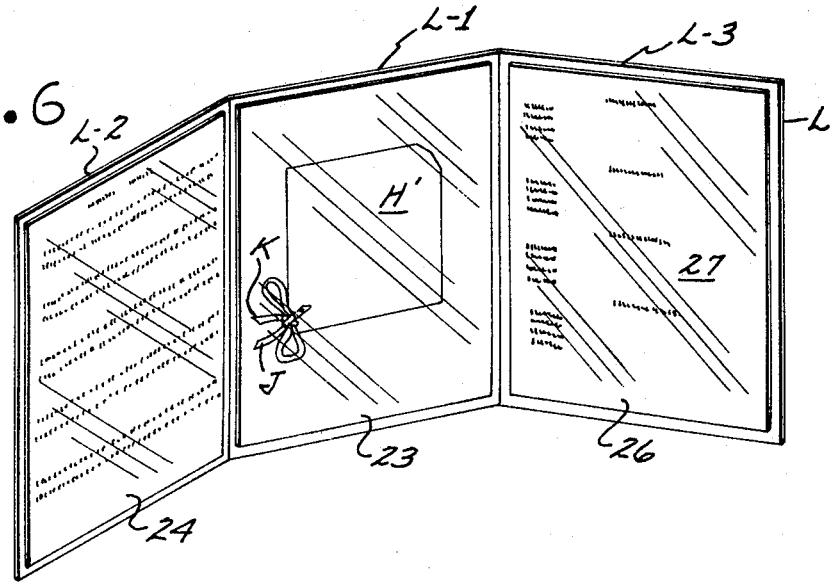
FIG. 6 is a perspective view of the message containing opaque folder in which the baby's christening bonnet is removably stored prior to again being used in the form of a handkerchief by a bride of a succeeding generation.

The handkerchief H is initially presented to the bride in a light opaque folder L shown in FIG. 6 that includes an intermediate rectangular panel member L-1 that has first and second panel members L-2 and L-3 pivotally secured to the sides thereof by first and second hinge means 20 and 21. The intermediate panel member supports a transparent envelope 23 on the interior surface thereof in which the bonnet H' may be stored after use.

The first panel L-2 on the interior surface thereof provides an area 24 on which insignia 25 is defined that is normally a congratulatory message. The second panel L-3 also provides an area 26 on the interior thereof on which an insignia 27 is defined that is preferably a record of the dates of weddings and christenings of successive generations of users of the invention. After the christening bonnet H' has been used it may be returned to the initial handkerchief configuration H by removing the stitchings 8, 14 and 15 with the handkerchief than being available to be carried by a bride.

The use and operation of the invention has been described previously in detail and need not be repeated.

What is claimed is:

1. In combination with a protective folder, a substantially square handkerchief of woven material and first and second ribbons of substantially equal length, said handkerchief capable of being carried as such by a bride at a wedding and subsequently said handkerchief and first and second ribbons when removably combined cooperating to define a baby's christening bonnet, said handkerchief after use at said wedding and a christening being stored in said protective folder, said handkerchief formed from a foldable cloth and being substantially square and having first and second side edges and first and second end edges, said handkerchief prior to defining said christening cap having first, second and third fold lines formed therein, said first fold line intermediately disposed between said first and second edges and parallel thereto to divide said handkerchief into first and second rectangular panels, said second panel overlying said first panel, said second and third fold lines dividing said first and second panels into first and second generally triangular shaped segments that are separated by a generally trapezoidal intermediate segment, said first and second triangular segments each having first and second segments overlying a major portion of said intermediate segment, with portions of said first and second segments adjacent said intermediate segment overlapping one another; first means for removably securing said portions of said first and second segments together to define said bonnet, said bonnet having the top and sides thereof defined by said first panel and the rear thereof by said second panel, with the forward edge of said bonnet defined by said first end edge of said first panel, and the lower side edges and rear edge of said bonnet by said first and second side edges of said first panel; and second means for removably securing said first and second ribbons to the lower forward extremities of the sides of said bonnet, said first and second ribbons capable of being extended under the chin of a baby and tied to retain the bonnet in place on the baby's head, with the first and second means capable of being removed to permit the bonnet to be returned to the initial hankerchief configuration to again be used for the same purpose by subsequent generations.

2. The combination as defined in claim 1 in which said first means is light stitching.

3. The combination as defined in claim 1 in which said second means is light stitching.

4. The combination as defined in claim 1 in which said protective folder includes:

a. a first rectangular panel member having a first side surface and first and second side edges;

b. an envelope secured to said first side surface, said envelope capable of receiving said bonnet for storage purposes;

c. a second rectangular panel member formed from an opaque material and having a first side edge, said second panel member of substantially the same size as said first panel member; and d. first hinge means that connect said first side edges of said first and second panel members to permit said second panel member to overlie said envelope and bonnet and protect the latter against the deteriorating action of light.

5. The combination as defined in claim 4 in which said second panel member includes a first side surface, and said combination including:

e. a sheet secured to said first side surface of said panel member, with said sheet having insignia defined on the exposed surface thereof.

6. The combination as defined in claim 4 which in addition includes:

e. a third rectangular panel member having a first side surface edge and first side surface;

f. second hinge means that connect said second side edge of said first panel member to said first side edge of said third panel member to permit said third panel member to overlie said second panel member when the latter overlies said first panel member.

7. The combination as defined in claim 6 which in addition includes:

g. a second sheet secured to said first side surface of said third panel member, said second sheet having insignia defined on an exposed surface thereof that indicates the use of said handkerchief as a christening bonnet by succeeding generations.

* * * * *